US008434455B2

(12) United States Patent
Takeuchi et al.

(10) Patent No.: US 8,434,455 B2
(45) Date of Patent: May 7, 2013

(54) CONTROL SYSTEM FOR INTERNAL COMBUSTION ENGINE

(75) Inventors: Masahiro Takeuchi, Wako (JP); Sinobu Ochiai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 503 days.

(21) Appl. No.: 12/821,808

(22) Filed: Jun. 23, 2010

(65) Prior Publication Data

US 2011/0005492 A1 Jan. 13, 2011

(30) Foreign Application Priority Data

Jul. 7, 2009 (JP) ..... 2009-160730

(51) Int. Cl.
*F02P 5/00* (2006.01)

(52) U.S. Cl.
USPC ..... 123/406.23; 123/406.47; 123/434

(58) Field of Classification Search ..... 701/103–105; 123/406.23, 406.11, 406.27, 434, 437, 339.1, 123/339.11
See application file for complete search history.

(56) References Cited

U.S. PATENT DOCUMENTS

| | | | | |
|---|---|---|---|---|
| 4,660,535 | A * | 4/1987 | Asano | 123/406.21 |
| 5,765,527 | A | 6/1998 | Lehner et al. | |
| 5,921,886 | A | 7/1999 | Takada et al. | |
| 6,058,906 | A * | 5/2000 | Yoshino | 123/295 |
| 6,318,349 | B1 * | 11/2001 | Muto et al. | 123/674 |
| 7,273,043 | B2 * | 9/2007 | Okubo et al. | 123/520 |
| 7,694,508 | B2 * | 4/2010 | Iida et al. | 60/285 |
| 7,770,558 | B2 * | 8/2010 | Takamiya et al. | 123/346 |
| 8,272,367 | B2 * | 9/2012 | Shikama et al. | 123/436 |
| 2005/0065705 | A1 | 3/2005 | Hartmann | |
| 2006/0102143 | A1 | 5/2006 | Yagi | |

FOREIGN PATENT DOCUMENTS

| | | | |
|---|---|---|---|
| FR | 2 864 930 | A1 | 7/2005 |
| JP | 10-503259 | | 3/1998 |
| JP | 2005-171900 | A | 6/2005 |
| JP | 2009-133276 | A | 6/2009 |
| WO | 96/35874 | | 11/1996 |

OTHER PUBLICATIONS

European Search Report application No. EP 10 16 7365 dated Oct. 6, 2010.

* cited by examiner

*Primary Examiner* — John Kwon
(74) *Attorney, Agent, or Firm* — Squire Sanders (US) LLP

(57) ABSTRACT

A control system for an internal combustion engine performs output control so that an engine output coincides with demand output by changing intake air flow rate or ignition timing of the engine. Output reduction control, wherein engine output is reduced, is performed when the demand output decreases. A retard limit output is calculated, and a retard limit intake air flow rate is calculated when the demand output is less than the retard limit output. The engine output is made to coincide with the demand output by retarding the ignition timing when the demand output is equal or greater than the retard limit output. When the demand output is less than the retard limit output, the ignition timing is retard to the limit and the intake air flow rate is controlled so as to coincide with the retard limit intake air flow rate.

8 Claims, 9 Drawing Sheets

TRQTGT
TRQIGRL

TRQTH

TH

IG
IGB
IGRL

TRQEG
t
t10
t11
t12

TRQTGT
TRQREQTH
TRQIGRL

TRQTH

TH

IG
IGB
IGRL

TRQEG
t
t20
t21
t22
t23
t24

CONTROL SYSTEM FOR INTERNAL COMBUSTION ENGINE

BACKGROUND OF THE INVENTION

1. Field of the Invention

The present invention relates to a control system for an internal combustion engine, and particularly to a control system which performs an engine output control by changing an intake air flow rate and an ignition timing.

2. Description of the Related Art

Japanese Patent Laid-open No. H10-503259 (JP-'259) discloses a control system which performs an engine output control by changing an intake air flow rate and an ignition timing. According to this control system, the intake air flow rate and the ignition timing are set so that the engine output can be increased by an amount of the previously-set torque margin by changing the ignition timing, and the engine output is increased by changing the ignition timing, for example, when the load on the engine increases in the idling condition. By changing the ignition timing to control the engine output, the engine output can rapidly be changed.

A rapid change in the engine output is required when performing the shift-change of the transmission connected to the output shaft of the engine. When performing the shift-up, for example, an output reduction control of the engine is performed in order to reduce the engine rotational speed, and an output increase control is subsequently performed for recovering the engine output.

As shown in JP-'259, the engine output control by changing the ignition timing has good response performance compared with the control by changing the intake air flow rate. Accordingly, it is preferable to perform the engine output control by changing the ignition timing. However, when the engine output is reduced by retarding the ignition timing, a possibility a misfire may occur becomes higher if the ignition timing is retarded beyond the retard limit. Therefore, it is necessary to perform the retard control within the range of the retard limit. However. JP-'259 does not disclose a method of controlling the ignition timing in the retarding direction taking the retard limit into consideration.

SUMMARY OF THE INVENTION

The present invention was made contemplating the above-described point, and an objective of the invention is to provide a control system for an internal combustion engine, which can appropriately control the intake air flow rate and/or the ignition timing in consideration of the retard limit of the ignition timing, to improve response performance of the engine output control in the transient state.

To attain the above objective, the present invention provides a control system for an internal combustion engine, which includes intake air flow rate control means (3, 7) for controlling an intake air flow rate (GAIR) of the engine, and performs an engine output control so that an output of the engine coincides with a demand output (TRQTGT) by changing at least one of the intake air flow rate (GAIR) and an ignition timing (IG) of the engine. The control system includes output reduction control means, retard limit calculating means, retard limit output calculating means, and retard limit intake air flow rate calculating means. The output reduction control means performs an output reduction control in which the engine output is reduced by changing at least one of the intake air flow rate and the ignition timing, when the demand output (TRQTGT) decreases. The retard limit calculating means calculates a retard limit (IGRL) of the ignition timing according to an operating condition of the engine. The retard limit output calculating means calculates a retard limit output (TRQIGRL) which is an output of the engine corresponding to a state where the ignition timing is retarded to the retard limit (IGRL) and the intake air flow rate is maintained at a value (GAIRDRV) immediately before the demand output decreases. The retard limit intake air flow rate calculating means calculates a retard limit intake air flow rate (GAIRTGT) when the demand output (TRQTGT) is less than the retard limit output (TRQIGRL). The retard limit intake air flow rate (GAIRTGT) is an intake air flow rate at which the engine output is equal to the demand output (TRQTGT) under the condition where the ignition timing is retarded to the retard limit (IGRL). The output reduction control means makes the engine output coincide with the demand output (TRQTGT) by retarding the ignition timing, when the demand output (TRQTGT) is equal to or greater than the retard limit output (TRQIGRL). When the demand output (TRQTGT) is less than the retard limit output (TRQIGRL), the output reduction control means retards the ignition timing to the retard limit (IGRL) and controls the intake air flow rate control means so that the intake air flow rate coincides with the retard limit intake air flow rate (GAIRTGT).

With this configuration, the retard limit of the ignition timing is calculated according to the engine operating condition, and the retard limit output, which is an engine output corresponding to the state where the ignition timing is retarded to the retard limit and the intake air flow rate is maintained at a value immediately before the demand output decreases, is calculated. If the demand output is less than the retard limit output, it is impossible to reduce the engine output to the demand output only by retarding the ignition timing. Accordingly, the retard limit intake air flow rate, which is an intake air flow rate at which the engine output becomes equal to the demand output under the condition where the ignition timing is retarded to the retard limit, is calculated. Subsequently, the ignition timing is retarded to the retard limit, and the intake air flow rate control means is controlled so that the intake air flow rate coincides with the retard limit intake air flow rate.

On the other hand, if the demand output is equal to or greater than the retard limit output, it is possible to reduce the engine output to the demand output only by retarding the ignition timing. Accordingly, the ignition timing is retarded so that the engine output coincides with the demand output. Therefore, in the transient control for reducing the engine output when the demand output decreases from the present engine output, the engine output reduction is performed by retarding the ignition timing in consideration of the retard limit as much as possible, thereby improving response performance of the engine output control.

Preferably, the control system further includes output increase control means for performing an output increase control so that the engine output coincides with the demand output (TRQTGT) when the demand output (TRQTGT) increases after the output reduction control by the output reduction control means. The output increase control means increases the intake air flow rate (GAIR) until the demand output (TRQTGT) reaches the retard limit output (TRQIGRL) when the ignition timing is set to the retard limit (IGRL), and advances the ignition timing when the demand output (TRQTGT) exceeds the retard limit output (TQRIGRL).

With this configuration, when the demand output increases after the output reduction control and the ignition timing is set to the retard limit, the intake air flow rate is increased until the demand output reaches the retard limit output. Further, when the demand output exceeds the retard limit output, the output increase control is performed by advancing the ignition timing so that the engine output coincides with the demand output. Therefore, when the demand output further changes immediately after the increase in the demand output, the output control can be performed by advancing or retarding the ignition timing, which improves response performance of the engine output control.

The present invention provides another control system for an internal combustion engine, which includes intake air flow rate control means (3, 7) for controlling an intake air flow rate (GAIR) of the engine, and performs an engine output control so that an output of the engine coincides with a demand output (TRQTGT) by changing at least one of the intake air flow rate (GAIR) and an ignition timing (IG) of the engine. The control system includes basic ignition timing calculating means, normal output control means, output maintenance control means, retard limit calculating means, basic increased intake air flow rate calculating means, retard limit output calculating means, and retard limit intake air flow rate calculating means. The basic ignition timing calculating means calculates a basic ignition timing (IGB) according to an operating condition of the engine. The normal output control means sets the ignition timing to the basic ignition timing (IGB) and controls the intake air flow rate control means so that the engine output coincides with the demand output (TRQTGT). The output maintenance control means performs an output maintenance control in which the engine output is maintained at a present value as preparation for increasing the engine output to an increased demand output (TRQREQTH). The retard limit calculating means calculates a retard limit (IGRL) of the ignition timing according to the operating condition of the engine. The basic increased intake air flow rate calculating means calculates a basic increased intake air flow rate (GAIRRT) when the output maintenance control is requested. The basic increased intake air flow rate (GAIRRT) is an intake air flow rate at which the increased demand output (TRQREQTH) is obtained under the condition where the ignition timing is set to the basic ignition timing (IGB). The retard limit output calculating means calculates a retard limit output (TRQIGRL) which is an output of the engine corresponding to a state where the ignition timing is retarded to the retard limit (IGRL) and the intake air flow rate is equal to the basic increased intake air flow rate (GAIRRT). The retard limit intake air flow rate calculating means calculates a retard limit intake air flow rate (GAIRTGT) when the present value of the engine output is less than the retard limit output (TRQIGRL). The retard limit intake air flow rate (GAIRTGT) is an intake air flow rate at which the engine output is equal to the present value under the condition where the ignition timing is retarded to the retard limit (IGRL). The output maintenance control means controls the intake air flow rate control means so that the intake air flow rate coincides with the basic increased intake air flow rate (GAIRRT), and retards the ignition timing so that the engine output is maintained at the present value, when the present value of the engine output is equal to or greater than the retard limit output (TRQIGRL). When the present value of the engine output is less than the retard limit output (TRQIGRL), the output maintenance control means retards the ignition timing to the retard limit (IGRL) and controls the intake air flow rate control means so that the intake air flow rate coincides with the retard limit intake air flow rate (GAIRTGT).

With this configuration, the ignition timing is normally set to the basic ignition timing, and the intake air flow rate control means is controlled so that the engine output coincides with the demand output. The retard limit of the ignition timing is calculated according to the engine operating condition. The basic increased intake air flow rate, which is an intake air flow rate at which the increased demand output is obtained under the condition where the ignition timing is set to the basic ignition timing, is calculated when the output maintenance control is requested for maintaining the engine output at the present value as preparation for increasing the engine output to the increased demand output. Further, the retard limit output, which is an engine output corresponding to the state where the ignition timing is retarded to the retard limit and the intake air flow rate is equal to the basic increased intake air flow rate, is calculated. The retard limit intake air flow rate, which is an intake air flow rate at which the engine output becomes equal to the present value under the condition where the ignition timing is retarded to the retard limit, is calculated when the present value of the engine output is less than the retard limit output. If the present value of the engine output is greater than the retard limit output, the output maintenance control is performed as follows: the intake air flow rate control means is controlled so that the intake air flow rate coincides with the basic increased intake air flow rate, and the ignition timing is retarded so as to maintain the engine output at the present value.

On the other hand, if the present value of the engine output is less than the retard limit output, the ignition timing is retarded to the retard limit, and the output maintenance control is performed to control the intake air flow rate control means so that the intake air flow rate coincides with the retard limit intake air flow rate. By performing the output maintenance control, it is possible to maintain the engine output at the present value and quickly respond to the subsequent engine output increase request, thereby improving response performance of the engine output increase control.

DETAILED DESCRIPTION OF THE PREFERRED EMBODIMENTS

Preferred embodiments of the present invention will now be described with reference to the drawings.

Figure 1:
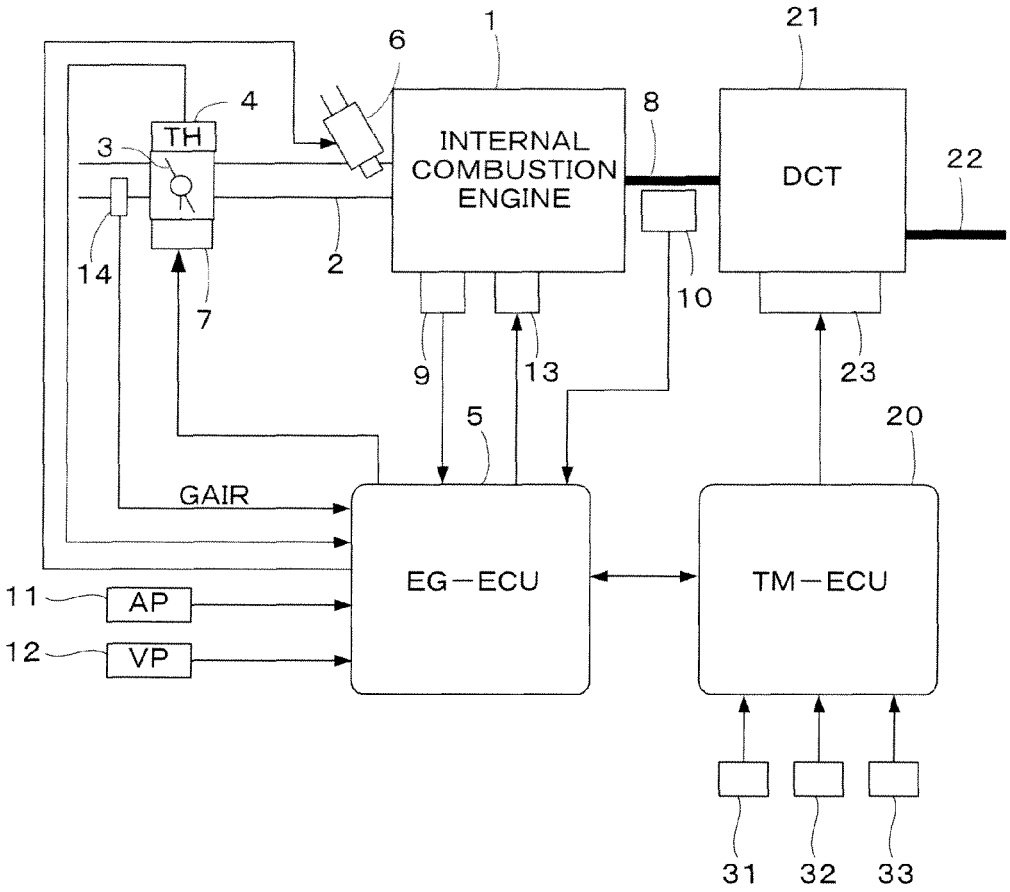
FIG. 1 is a schematic diagram showing a configuration of an internal combustion engine and a transmission mechanism for driving a vehicle and a control system therefor according to one embodiment of the present invention.

FIG. 1 is a schematic diagram showing a configuration of an internal combustion engine and a transmission mechanism for driving a vehicle and a control system therefor according to one embodiment of the present invention. An internal combustion engine (hereinafter referred to as "engine") has an intake pipe 2 provided with a throttle valve 3. The throttle valve 3 is provided with a throttle valve opening sensor 4 for detecting an opening TH of the throttle valve 3, and a detection signal of the throttle valve opening sensor 4 is supplied to an electronic control unit 5 for the engine control (this electronic control unit will be hereinafter referred to as "EG-ECU"). An actuator 7 for actuating the throttle valve 3 is connected to the throttle valve 3, and the operation of the actuator 7 is controlled by the EG-ECU 5.

A fuel injection valve 6 is provided for each cylinder at a position slightly upstream of an intake valve (not shown). Each injection valve is connected to a fuel pump (not shown) and electrically connected to the EG-ECU 5. A valve opening period of the fuel injection valve 6 is controlled by a signal from the EG-ECU 5. Each cylinder of the engine 1 is provided with a spark plug 13. The EG-ECU 5 supplies an ignition signal to each spark plug 13.

An intake air flow rate sensor 14 for detecting an intake air flow rate GAIR [g/sec] is provided upstream of the throttle valve 3 in the intake pipe 2. Further, a coolant temperature sensor 9 for detecting an engine coolant temperature TW is mounted on the body of the engine 1. The detection signals of these sensors 14 and 9 are supplied to the EG-ECU 5.

A crank angle position sensor 10 for detecting a rotational angle of the crankshaft 8 of the engine 1 is connected to the EG-ECU 5. A signal corresponding to the detected rotational angle of the crankshaft 8 is supplied to the EG-ECU 5. The crank angle position sensor 10 includes a cylinder discrimination sensor which outputs a pulse (hereinafter referred to as "CYL pulse") at a predetermined angle position of a specific cylinder of the engine 1. The crank angle position sensor includes a TDC sensor which outputs a TDC pulse at a crank angle position of a predetermined crank angle before a top dead center (TDC) starting an intake stroke in each cylinder and a CRK sensor for generating a CRK pulse with a crank angle period (e.g., a period of 6 degrees). The CYL pulse, TDC pulse and CRK pulse are supplied to the EG-ECU 5. The CYL pulse, the TDC pulse and the CRK pulse are used to control various timings, such as the fuel injection timing and the ignition timing, and to detect an engine rotational speed NE.

An accelerator sensor 11 and a vehicle speed sensor 12 are connected to the EG-ECU 5. The accelerator sensor 11 detects a depression amount AP of an accelerator pedal of the vehicle driven by the engine 1 (this depression amount will hereinafter referred as to "accelerator operation amount"). The vehicle speed sensor 12 detects a vehicle speed VP of the vehicle driven by the engine 1. The detection signals of these sensors 11 and 12 are supplied to the EG-ECU 5.

The EG-ECU 5 includes an input circuit having various functions including a function of shaping the waveforms of the input signals from the various sensors, a function of correcting the voltage level of the input signals to a predetermined level, and a function converting analog signal values into digital signal values. The EG-ECU 5 may further include a central processing unit (hereinafter referred to as "CPU"), a memory circuit, and an output circuit. The memory circuit preliminarily stores various operating programs to be executed by the CPU and the results of computation or the like by the CPU. The output circuit supplies drive signals to the actuator 7, the fuel injection valve 6, the spark plug 13, and the like.

The EG-ECU 5 performs a valve opening period control of the fuel injection valve 6 and an ignition timing control based on the detection signals of the sensors described above. The ECU calculates a target opening THCMD of the throttle valve 3, and performs a drive control of the actuator 7 so that the detected throttle valve opening TH coincides with a target opening THCMD. The target opening THCMD is calculated according to a first target torque TRQTH. In the normal control, the throttle valve opening TH (the intake air flow rate of the engine 1) is controlled so that the output torque of the engine 1 coincides with the first target torque TRQTH.

Further, in this embodiment, the ignition timing IG in the normal control is set to a basic ignition timing IGB which is an ignition timing at which the output torque of the engine 1 reaches the maximum value within the range where no knocking occurs. Further, a second target torque TRQIG which is a target torque for an ignition timing control is calculated, and the ignition timing IG is set according to the second target torque TRQIG as described below, for example, when performing the shift-up of the transmission.

The crankshaft 8 of the engine 1 is connected to the transmission mechanism 21, and the transmission mechanism 21 is controlled by the electronic control unit 20 for the transmission control (this electronic control unit will be hereinafter referred to as "TM-ECU") through an oil pressure control unit 23. The transmission mechanism 21 has an output shaft 22, and the output shaft 22 drives driving wheels of the vehicle through a driving force transfer mechanism (not shown).

In this embodiment, the transmission mechanism 21 is a dual clutch transmission having two clutches, which will be hereinafter referred to as "DCT 21".

A shift lever switch 31, a paddle switch 32, and a sport mode switch 33 are connected to the TM-ECU 20, and switching signals from the switches 31 to 33 are supplied to the TM-ECU 20. The shift lever switch 31 outputs a signal indicative of the range selected by the shift lever (not shown), such as "D" range for automatically selecting the optimal shift position, "M" range for selecting the shift position according to the driver's instruction. "R" range for reverse running, "P" range for parking, and the like. The paddle switch 32 consists of a shift-up instruction switch and a shift-down instruction switch, and outputs a signal for demanding the shift-up or shift-down according to the driver's operation. The sport mode switch 33 is an on-off switch, which is turned on when the driver selects the sport mode.

The TM-ECU 20 includes an input circuit, a CPU, a memory circuit, and an output circuit similarly to the EG-ECU 5. The TM-ECU 20 is connected to the EG-ECU5, and the TM-ECU 20 and the EG-ECU 5 mutually transmit necessary information. For example, the accelerator operation amount AP, the vehicle speed VP, the engine rotational speed NE, and the like which are detected are transmitted from the EG-ECU 5 to the TM-ECU 20. On the other hand, a signal indicative of execution of the shift-change (the shift-up or shift-down), which is an engine torque control demand signal upon the shift-change, is transmitted from the TM-ECU 20 to the EG-ECU 5.

The TM-ECU 20 performs an automatic shift-change control based on the accelerator operation amount AP, the vehicle speed VP, the engine rotational speed NE, and the like, or a shift-change control according to the driver's instruction.

Figure 2:
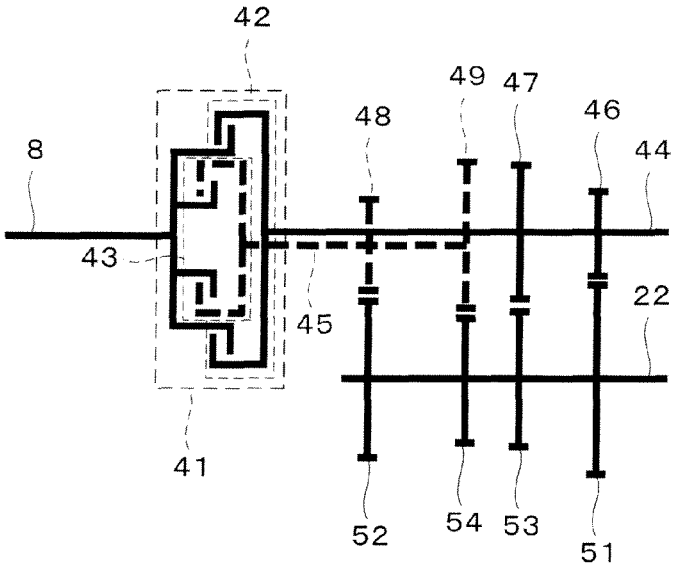
FIG. 2 is a diagram for illustrating a configuration of the transmission mechanism shown in FIG. 1.

FIG. 2 shows a part of simplified configuration of the DCT 31, in which 1st to 4th speed gears are shown. The crankshaft 8 of the engine 1 is connected to a clutch mechanism 41 which includes a first clutch 42 connected to a first main shaft 44, and a second clutch 43 connected to a second main shaft 45.

On the first main shaft 44, a first drive gear 46 and a third drive gear 47 are supported, and a second drive gear 48 and a fourth drive gear 49 are supported on the second main shaft 45. A first driven gear 51, a second driven gear 52, a third driven gear 53, and a fourth driven gear 54 are supported on an output shaft 55.

Engagement and disengagement of the first and second clutches 42 and 43, and the shift position change are performed by the oil pressure control unit 23.

Figure 3:
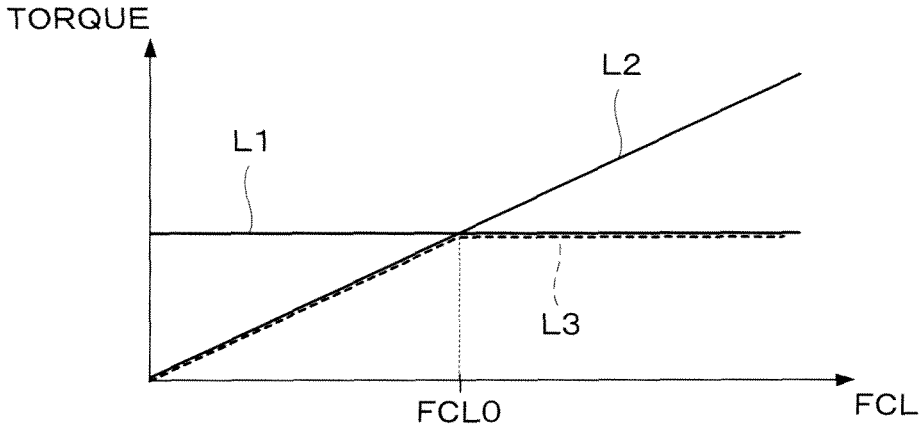
FIG. 3 is a graph for illustrating a relationship of an engine output torque, a clutch torque, and a transfer torque.

FIG. 3 is a diagram for illustrating a relationship between an engaging force FCL of the clutch and a transfer torque TTM through the clutch. The solid lines L1 and L2 shown in FIG. 3 respectively show an engine output torque TRQEG and a clutch torque TRQCL, and the dashed line L3 shows the transfer torque TTM. The clutch torque TRQCL is defined as a maximum torque that the clutch can transmit, and the clutch torque TRQCL is proportional to the engaging force FCL. Although the dashed line L3 actually overlaps with the solid lines L1 or L2, the dashed line 3 is illustrated as slightly shifted for easy recognition.

In the range where the engaging force FCL is less than a predetermined value FCL0, the engine output torque TRQEG is greater than the clutch torque TRQCL. Accordingly, the clutch disks slip and the transfer torque TTM becomes equal to the clutch torque TRQCL. In the range where the engaging force FCL is equal to or greater than the predetermined values FCL0, the engine output torque TRQEG is transmitted by the clutch with no slip. Accordingly, the transfer torque TIM is equal to the engine output torque TRQEG.

In this embodiment, when performing the shift-up of the DCT 21 (e.g., from 3rd-speed position to 4th-speed position), the fourth drive gear 49 is meshed with the fourth driven gear 54 at the beginning of the shift-up when the 3rd-speed position is selected, and the disengaging operation in which the engaging force of the first clutch 42 is gradually reduced is performed in parallel with the engaging operation in which the engaging force of the second clutch 43 is gradually increased. Accordingly, the shift-up can be performed with maintaining the torque transfer through the clutch mechanism 41.

FIGS. 4A to 4E are time charts for illustrating the clutch torque control and the engine torque control when performing the shift-up of the DCT 21. FIGS. 4A to 4E show an example where the shift-up operation is started at time tS, and completed at time tE.

Figures 4A, 4B, 4C, 4D, 4E:
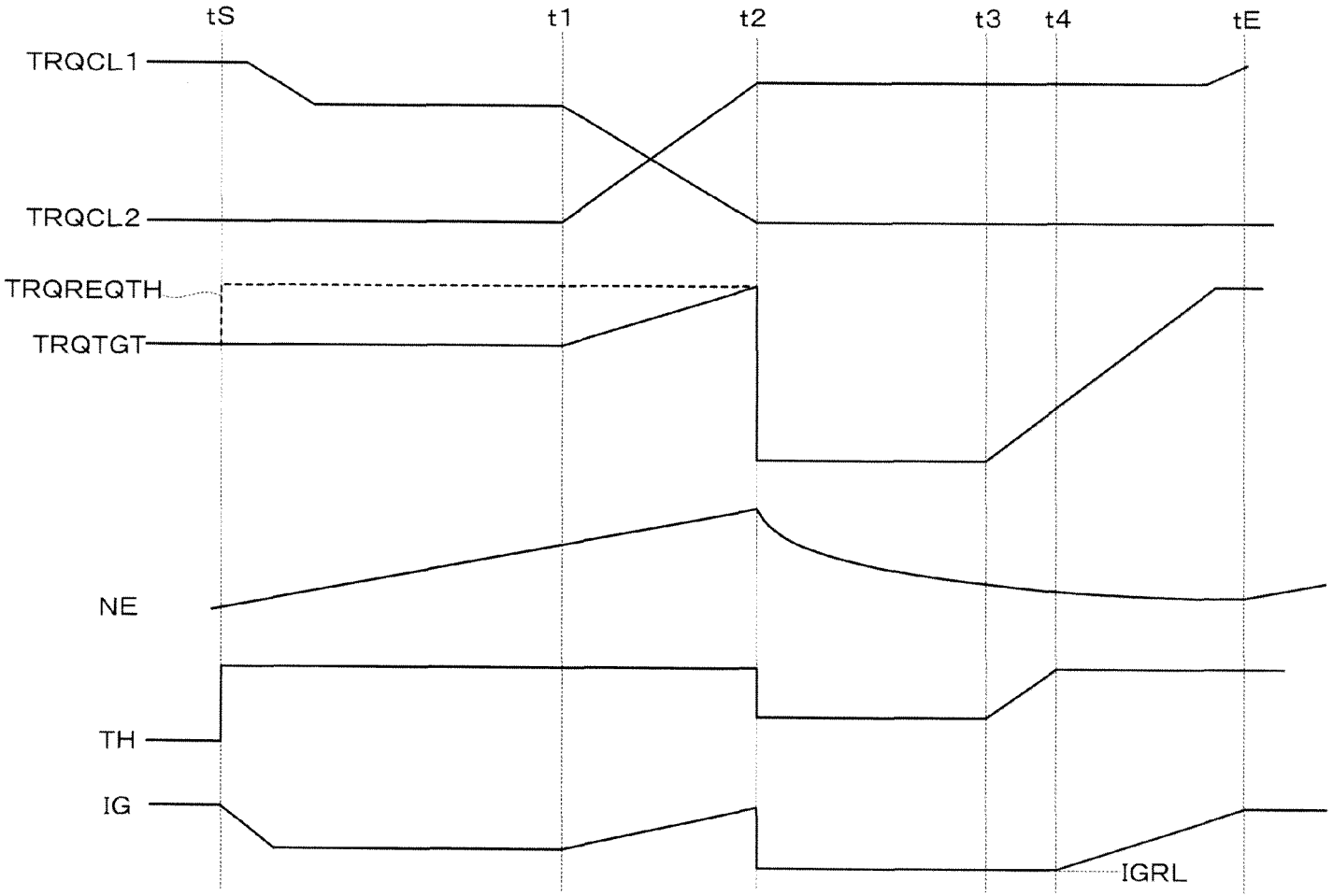
FIGS. 4A-4E show time charts for illustrating a control when performing the shift-up of the transmission.

In FIG. 4A, changes in the clutch torques TRQCL1 and TRQCL2 of the first and second clutches 42 and 43 are shown. The disengaging operation of the first clutch 42 for reducing the clutch torque TRQCL1 is performed in parallel with the engaging operation of the second clutch 43 for increasing the clutch torque TRQCL2.

In FIG. 4B, changes in an engine demand torque (hereinafter referred to as "TM demand torque") TRQTGT which is transmitted from the TM-ECU 20 to the EG-ECU 5 when performing the shift-change are shown by the solid line, and changes in an increased demand torque TRQREQTH which should be attained at time t2 are shown by the dashed line. FIGS. 4C to 4E respectively show changes in the engine rotational speed NE, the throttle valve opening TH, and the ignition timing IG.

During the period from time t1 to time t2, it is necessary to increase the engine output torque to the increased demand torque TRQREQTH. Therefore, a torque maintenance request as preparation for increasing the output torque to the increased demand torque TRQREQTH, is transmitted from the TM-ECU 20 to the EG-ECU 5 at time tS. In response to the torque maintenance request, the increased demand torque TRQREQTH increases stepwise and the TM demand torque TRQTGT is maintained at the present value of the engine output torque. Accordingly, the valve opening of the throttle valve 3 is performed in parallel with retarding of the ignition timing IG, to prepare execution of the torque increase control starting from time t1 with maintaining the output torque at the present value. This preparation makes it possible to perform the torque increase control only by advancing the ignition timing IG.

Therefore, during the period from time t1 to time t2, the TM demand torque TRQTGT gradually increases, and the ignition timing IG is gradually advanced in response to the increase in the TM demand torque TRGTGT.

At time t2, the TM demand torque TRQTGT decreases stepwise in order to reduce the engine rotational speed NE, and the throttle valve opening TH and the ignition timing IG decreases stepwise in accordance with the decrease in the TM demand torque TRQTGT. Consequently, the engine output torque decreases to reduce the engine rotational speed NE.

The TM demand torque TRQTGT begins to increase from time t3, and gradually increases to reach the driver demand torque TRQDRV corresponding to the accelerator operation amount AP. Accordingly, the throttle valve opening TU begins to increase from time t3, and increases to an opening corresponding to the driver demand torque TRQDRV (time t4). From time t4, the ignition timing IG increases (advances), and the engine output torque is controlled to coincide with the TM demand torque TRQTGT.

Figure 5A:
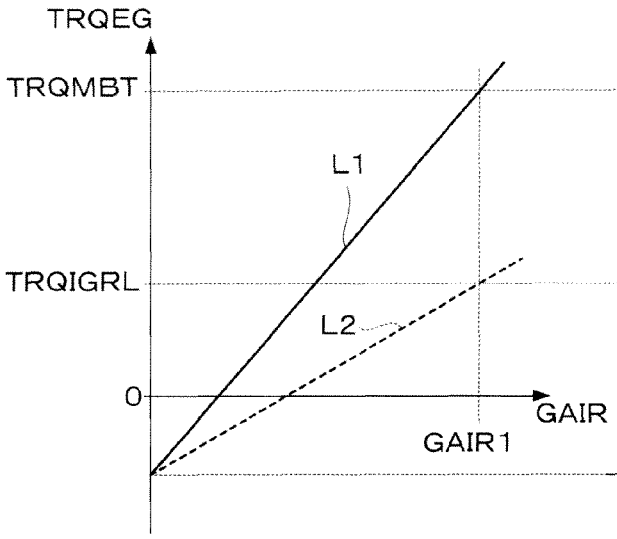
FIGS. 5A and 5B respectively show graphs for illustrating a relationship between an engine output torque (TRQEG) and an intake air flow rate (GAIR), and a relationship between the engine output torque (TRQEG) and an ignition timing (IG)
Figure 5B:
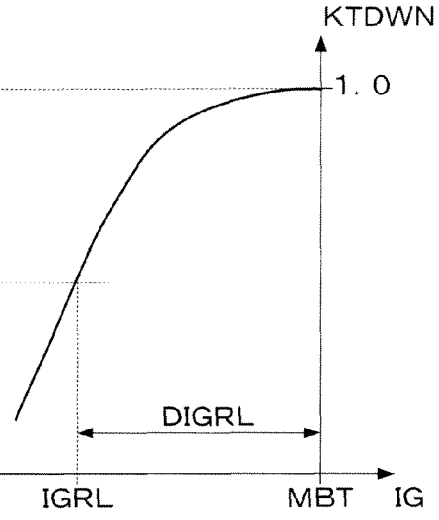

FIG. 5A shows a graph for illustrating a relationship between the intake air flow rate GAIR and the engine output torque TRQEG, and FIG. 5B shows a graph for illustrating a relationship between the ignition timing IG and a torque reduction ratio KTDWN. The torque reduction ratio KTDWN indicates a ratio of the output torque with respect to the reference torque corresponding to the state where the ignition timing IG is set to the optimal ignition timing MBT at which the engine output torque TRQEG becomes maximum. The torque reduction ratio KTDWN decreases as the retard amount of the ignition timing IG increases. If the ignition timing IG is retarded exceeding the retard limit IGRL (=MBT−DIGRL), a misfire may occur. Therefore, the range which can be used for the output torque control is the range from the optimal ignition timing MBT to the retard limit IGRL.

In the normal operating condition, the ignition timing IG is set to the optimal ignition timing MBT. In this state, the relationship between the intake air flow rate GAIR and the engine output torque TRQEG is shown by the solid line L1 of FIG. 5A. Further, the dashed line L2 shows the relationship between the intake air flow rate GAIR and the engine output torque TRQEG corresponding to the state where the ignition timing IG is set to the retard limit IGRL.

As shown in FIG. 5A, if the intake air flow rate GAIR is equal to "GAIR1" and the ignition timing IG is set to the optimal ignition timing MBT, the output torque TRQEG is equal to the optimal ignition timing torque TRQMBT. On the other hand, if the intake air flow rate GAIR is equal to "GAIR1" and the ignition timing IG is set to the retard limit IGRL, the output torque is equal to the retard limit torque TRQIGRL.

Next, the control method for the time when the torque reduction request is transmitted from the TM-ECU 20 to the EG-ECU 5 will be described with reference to FIG. 6.

In the normal operating condition, the ignition timing IG is set to a basic ignition timing IGB, and the throttle valve opening TH is set to an opening which realizes the driver demand torque TRQDRV. Accordingly, the intake air flow rate GAIR is equal to a normal operation intake air flow rate GAIRDRV of the operating point P0. In the high load operating condition where a knocking may easily occur, the basic ignition timing IGB is set to a knock limit ignition timing which is set to a retarded value with respect to the optimal ignition timing MBT. In the low or middle load operating condition, the basic ignition timing IGB is set to the optimal ignition timing MBT.

If the ignition timing IG is retarded to the retard limit IGRL at the operating point P0, the operating point moves to the point P1 and the output torque TRQEG at the point P1 is the retard limit torque TRQIGRL. Therefore, when the TM demand torque TRQTGT is equal to or greater than the retard limit torque TRQIGRL, the TM demand torque TRQTGT is realized only by retarding the ignition timing IG.

Figure 6:
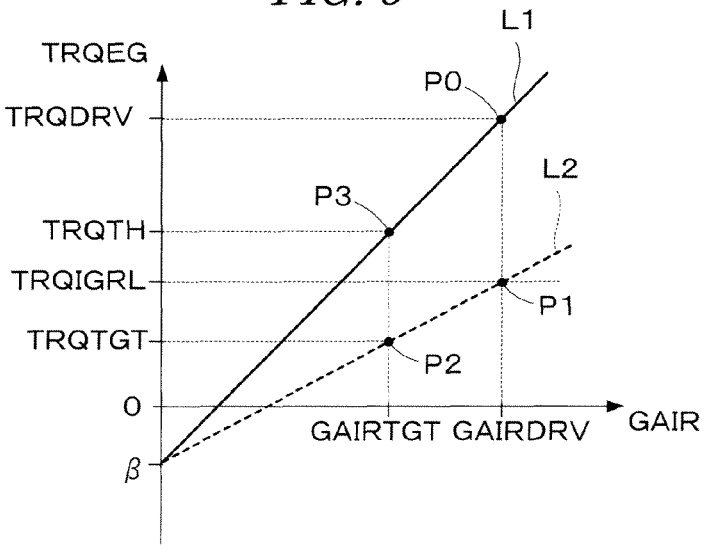
FIG. 6 is a graph for illustrating a torque reduction control.

As shown in FIG. 6, when the TM demand torque TRQTGT is less than the retard limit torque TRQIGRL, a retard limit intake air flow rate GAIRTGT is calculated. The retard limit intake air flow rate GAIRTGT is an intake air flow rate which realizes the TM demand torque TRQTGT in the state where the ignition timing IG is set to the retard limit IGRL. The operating point defined by the TM demand torque TRQTGT and the retard limit intake air flow rate GAIRTGT is indicated as the operating point P2 on the dashed line L2. Next, the first target torque TRQTH is set to an output torque corresponding to the operating point P3 on the solid line L1, i.e., the state where the intake air flow rate GAIR is equal to the retard limit intake air flow rate GAIRTGT and the ignition timing IG is equal to the basic ignition timing IGB. The first target torque TRQTH is applied to calculating the target throttle valve opening THCMD, which makes it possible to realize the TM demand torque TRQTGT with suppressing a reduction amount of the intake air flow rate GAIR at the minimum value, thereby improving response performance at the time of next torque increase request.

The solid line L1 and the dashed line L2 are respectively expressed with the following equations (1) and (2), wherein "α1" is an inclination of the solid line L1, "α2" is an inclination of the dashed line L2, and "β" is the output torque TRGEG in the state where GAIR is equal to "0", $$TRQEG=\alpha 1\times GAIR+\beta \quad (1)$$

$$TRQEG=\alpha 2\times GAIR+\beta \quad (2)$$

Therefore, the retard limit intake air flow rate GAIRTGT is given by the following equation (3) which is obtained using the equation (2). Further, the first target torque TRQTH is given by the following equation (4) by applying the retard limit intake air flow rate GAIRTGT to the equation (1).

$$GAIRTGT=(TRQTGT-\beta)/\alpha 2 \quad (3)$$

$$TRQTH=\alpha 1/\alpha 2(TRQTGT-\beta)\beta \quad (4)$$

Next, the control method for the time when the torque maintenance request is transmitted from the TM-ECU 20 to the EG-ECU 5 will be described with reference to FIG. 7. The dashed line L2*a* shown in FIG. 7 indicates a relationship between the intake air flow rate GAIR and the output torque TRQEG corresponding to the state where the retard limit IGRLa corresponding to the dashed line L2*a* is on the retard side with respect to the retard limit IGRL corresponding to the dashed line L2 (i.e., the state where IGRLa is less than IGRL).

Figure 7:
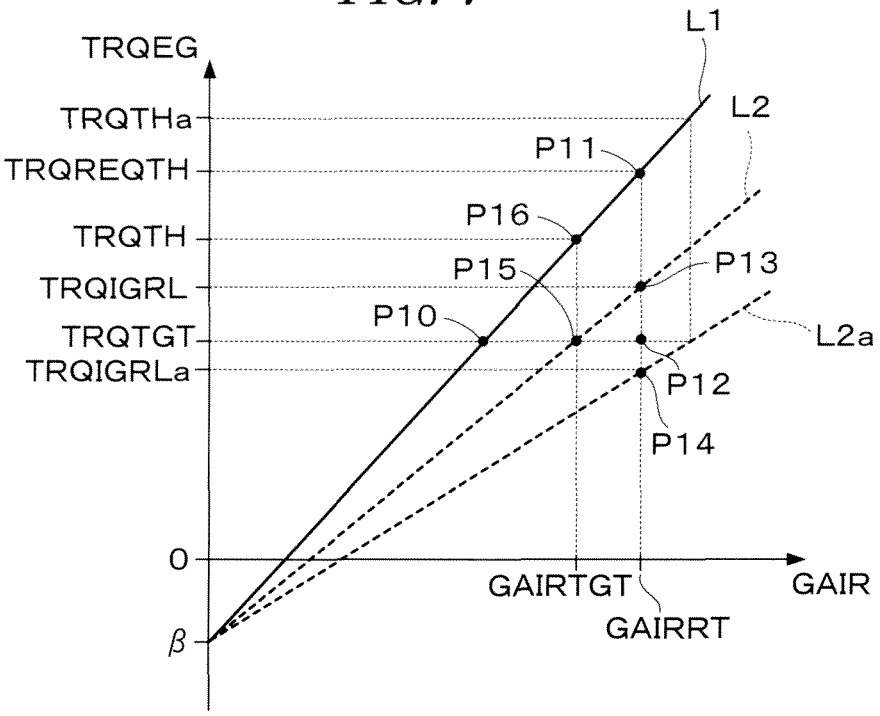
FIG. 7 is a graph for illustrating a torque maintenance control.

In FIG. 7, the present operating condition is indicated by the operating point P10. Since the request from the TM-ECU 20 is the torque maintenance request, the TM demand torque TRQTGT is equal to a torque corresponding to the operating point P10. The operating point corresponding to the increased demand torque TRQREQTH is indicated by the operating point P11. The intake air flow rate corresponding to the operating point P11, i.e. the intake air flow rate which can realize the increased demand torque TRQREQTH in the state where the ignition timing IG is set to the basic ignition timing IGB, will be hereinafter referred to as "basic increased intake air flow rate GAIRRT".

In the state where the intake air flow rate GAIR is equal to the basic increased intake air flow rate GAIRRT, the operating point which can realize the TM demand torque TRQTGT is indicated by the operating point P12. In order to explain the control method, two cases are defined as follows: the first case is a case that the relationship corresponding to the retard limit IGRL is indicated by the dashed line L2, and the second case is a case that the relationship corresponding to the retard limit IGRL is indicated by the dashed line L2*a*.

In the first case, the operating point P12 is in the region below the dashed line L2 (below the operating point P13), i.e., the present output torque TRQTGT (=TM demand torque) is less than the retard limit torque TRQIGRL. Accordingly, the retard limit intake air flow rate GAIRTGT which is an intake air flow rate corresponding to the operating point P15 on the dashed line L2, is calculated, and the first target torque TRQTH is set to a torque corresponding to the operating point P16. That is, in the first case, the output torque TRQEG is maintained at the TM demand torque TRQTGT by retarding the ignition timing IG to the retard limit IGRL and increasing the throttle valve opening TH according to the first target torque TRQTH. The retard limit intake air flow rate GAIRTGT and the first target torque TRQTH are respectively calculated by the above-described equations (3) and (4).

In the second case, the operating point P12 is in the region above the dashed line L2*a* (above the operating point P14). i.e. the present output torque TRQTGT (=TM demand torque) is greater than the retard limit torque TRQIGRLa. Accordingly, if the first target torque TRQTHa is calculated by the following equation (4a), the first target torque TRQTHa becomes greater than the increased demand torque TRQREQTH as shown in FIG. 7. Therefore, the first target torque TRQTH is set to the increased demand torque TRQREQTH, and the ignition timing IG is retarded so that the present output torque TRQTGT is maintained. "α3" in the equation (4a) is an inclination of the dashed line L2*a*.

$$TRQTHa=\alpha 1/\alpha 3(TRQTGT-\beta)\beta \quad (4a)$$

Figure 8:
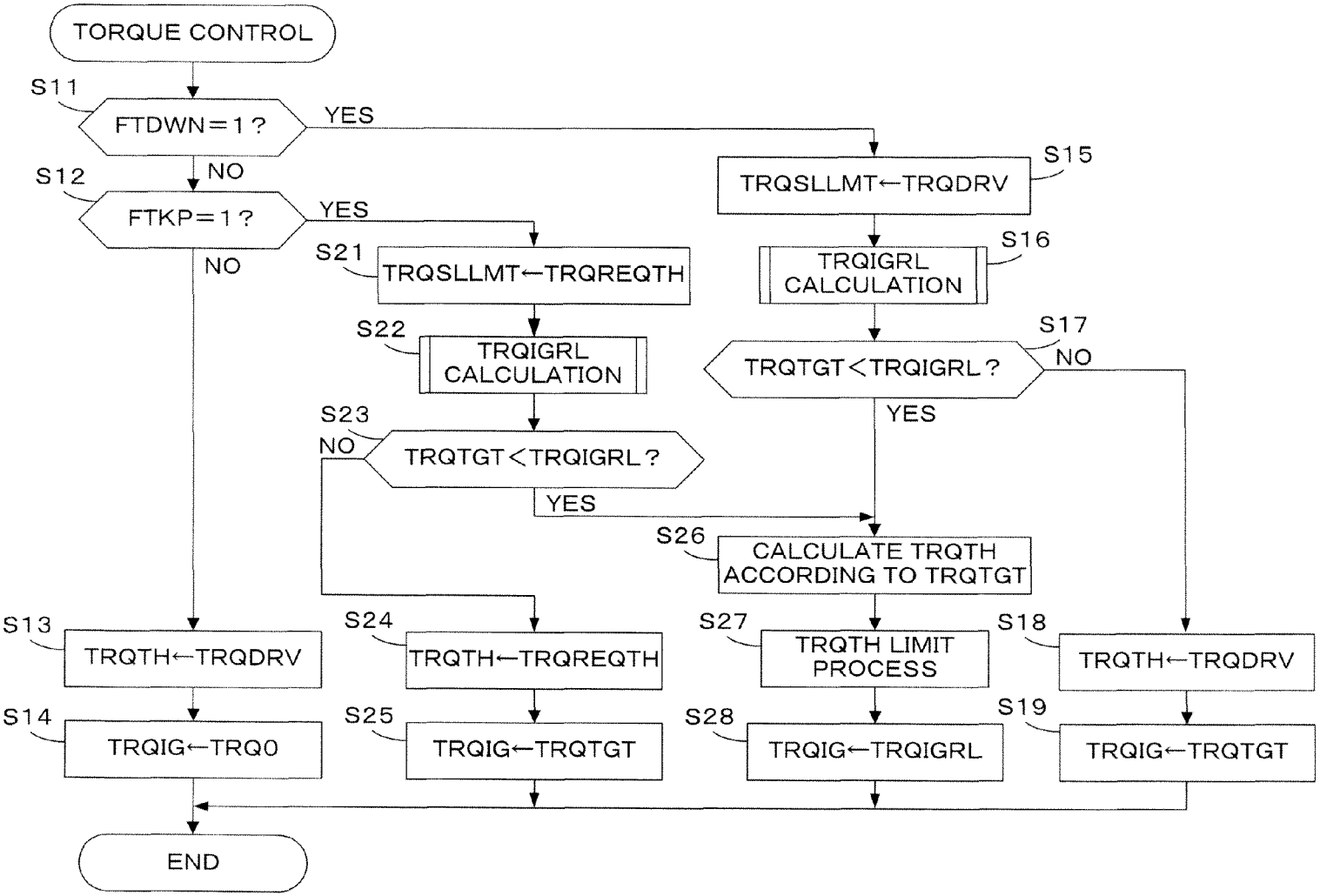
FIG. 8 is a flowchart of a process for performing the torque reduction control and the torque maintenance control.

FIG. 8 is a flowchart of a process for performing the above-described engine torque control. This process is executed at predetermined time intervals by the CPU in the EG-ECU 5.

In step S11, it is determined whether or not a torque reduction request flag FTDWN is equal to "1". The torque reduction request flag FTDWN is set to "1" when the torque reduction request is transmitted from the TM-ECU 20 to the EG-ECU 5. If the answer to step S11 is negative (NO), it is determined whether or not a torque maintenance request flag FTKP is equal to "1" (step S12). The torque maintenance request flag FTKP is set to "1" when the torque maintenance request as preparation for the torque increase control is transmitted from TM-ECU 20 to the EG-ECU 5.

If the answer to step S12 is also negative (NO), the first target torque TRQTH is set to the driver demand torque TRQDRV (step S13), and the second target torque TRQIG is set to a predetermined value TRQ0 (e.g., "0") for performing the normal control (step S14). When neither the torque reduction request nor the torque maintenance request is transmitted, the throttle valve opening control according to the driver demand torque TRQDRV and the normal ignition timing control are performed. In the normal ignition control, the ignition timing IG is set to the basic ignition timing IGB.

Figure 9:
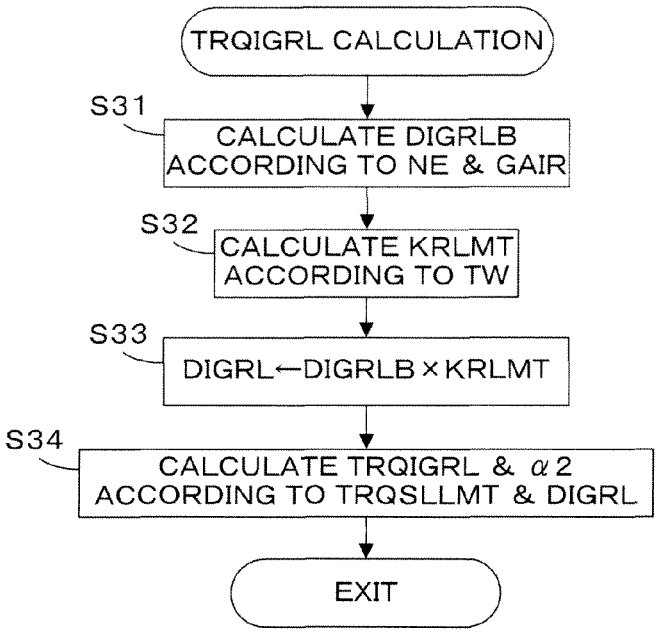
FIG. 9 is a flowchart of a TRQIGRL calculation process executed in the process of FIG. 8.

If the answer to step S11 is affirmative (YES), i.e., if the torque reduction control is performed, a temporary target torque TRQSLLMT is set to the present driver demand torque TRQDRV (step S15), and a TRQIGRL calculation process shown in FIG. 9 is executed (step S16). In the TRQIGRL calculation process, the retard limit torque TRQIGRL is calculated according to the temporary target torque TRQSLLMT and the engine operating condition.

Figure 10A:
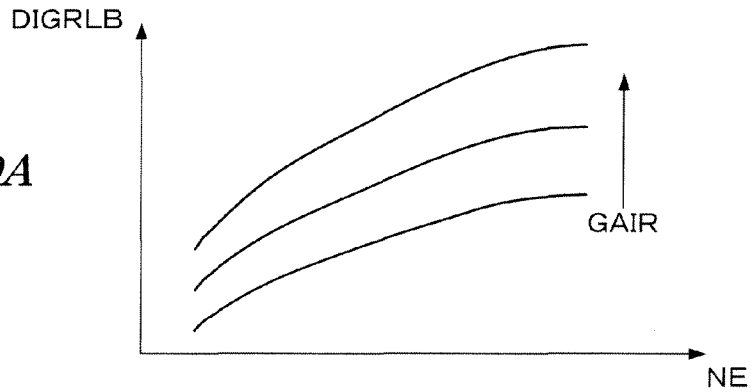
FIGS. 10A and 10B show a map and a table referred to in the process of FIG. 9.

In step S31 of FIG. 9, a DIGRLB map shown in FIG. 10A is retrieved according to the engine rotational speed NE and the intake air flow rate GAIR, to calculate a basic retard limit amount DIGRLB. The DIGRLB map is set so that the basic retard limit amount DIGRLB increases as the engine rotational speed NE increases, and the basic retard limit amount DIGRLB increases as the intake air flow rate GAIR increases.

Figure 10B:
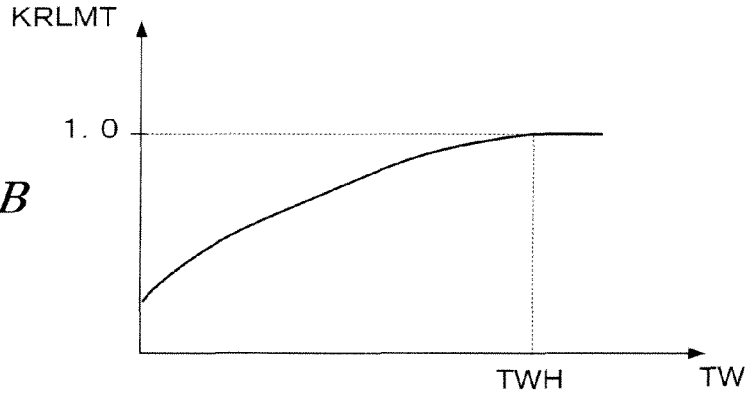

In step S32, a KRLMT table shown in FIG. 10B is retrieved according to the engine coolant temperature TW, to calculate a retard limit amount correction coefficient KRLMT. The KRLMT table is set so that the retard limit amount correction coefficient KRLMT decreases as the engine coolant temperature TW decreases. A predetermined water temperature TWH shown in FIG. 10B is set, for example, to 80 degrees centigrade.

In step S33, the retard limit amount DIGRL is calculated by multiplying the retard limit amount correction coefficient KRLMT with the basic retard limit amount DITRLB as shown by the following equation (5). The above-described retard limit IGRL is an ignition timing which is obtained by subtracting the retard limit amount DIGRL from the basic ignition timing IGB as shown by the following equation (6).

$$DIGRL = DIGRLB \times KRLMT \quad (5)$$

$$IGRL = IGB - DIGRL \quad (6)$$

In step S34, the retard limit torque TRQIGRL is calculated according to the temporary target torque TRQSLLMT and the retard limit amount DIGRL (refer to FIG. 5), and the inclination $\alpha 2$ of the characteristic straight line (dashed line L2 shown in FIG. 5) corresponding to the state where the ignition timing IG is set to the retard limit IGRL, is calculated.

Referring back to FIG. 8, in step S17, it is determined whether or not the TM demand torque TRQTGT is less than the retard limit torque TRQIGRL. If the answer to step S17 is negative (NO), the TM demand torque TRQTGT can be realized only by retarding the ignition timing IG. Accordingly, the first target torque TRQTH is set to the driver demand torque TRQDRV (step S18) and the second target torque TRQIG is set to the TM demand torque TRQTGT (step S19). With this setting of TRQTH and TRQIG, the torque reduction control which realizes the TM demand torque TRQTGT is performed by changing the ignition timing IG.

If the answer to step S17 is affirmative (YES), i.e., the TM demand torque TRQTGT is less than the retard limit torque TRQIGRL, the inclination $\alpha 2$ and the TM demand torque TRQTGT are applied to the above-described equation (4), to calculate the first target torque TRQTH (step S26). As to the parameters of $\alpha 1$ and $\beta$ in the equation (4), the previously calculated values are applied.

In step S27, a limit process is performed so that the calculated first target torque TRQTH does not exceed the temporary target torque TRQSLLMT. In step S28, the second target torque TRQIG is set to the retard limit torque TRQIGRL.

If the answer to step S12 is affirmative (YES). i.e. the torque maintenance control is performed, the temporary target torque TRQSLLMT is set to the increased demand torque TRQREQTH (step S21), and the TRQIGRL calculation process of FIG. 9 is performed (step S22). In step S23, it is determined whether or not the TM demand torque TRQTGT (which is equal to the present output torque) is less than the retard limit torque TRQIGRL.

If the answer to step S23 is affirmative (YES), the process proceeds to step S26, in which the control corresponding to the above-described first case is performed. On the other hand, if the answer to step S23 is negative (NO), the first target torque TRQTH is set to the increased demand torque TRQREQTH (step S24) and the second target torque TRQIG is set to the TM demand torque TRQTGT (step S25). With this setting of TRQTH and TRQIG, the control corresponding to the above-described second case is performed.

Figures 11A, 11B, 11C, 11D, 11E:
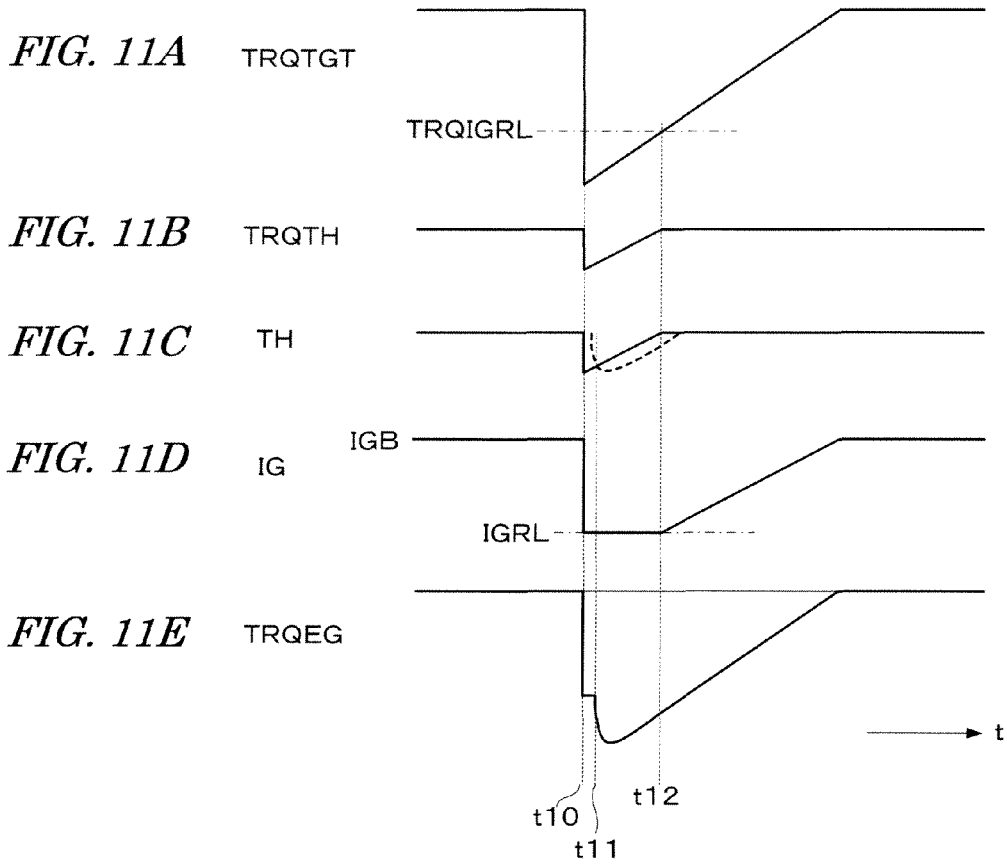
FIGS. 11A-11E show time charts for illustrating the torque reduction control.

FIGS. 11A-11*e* are time charts for illustrating the torque reduction control described above, and respectively show changes in the TM demand torque TRQTGT, the first target torque TRQTH, the throttle valve opening TH, the ignition timing IG, and the engine output torque TRQEG. In FIG. 11C, the dashed line shows changes in the intake air flow rate corresponding to the changes in the throttle valve opening TH.

As shown in FIG. 11A, the TM demand torque TRQTGT is reduced when the torque reduction request is transmitted at time t10, and the TM demand torque TRQTGT is less than the retard limit torque TRQIGRL during the period from time t10 to time t12. Accordingly, the first target torque TRQTH is set to a value calculated in step S26 of FIG. 8, and the throttle valve opening TH changes according to the first target torque TRQTH.

The ignition timing IG is set to the retard limit IGRL during the period from time t10 to time t12, and increases (advances) after time t12 according to the increase in the TM demand torque TRQTGT. Although the engine output torque TRQEG changes so as to follow the TM demand torque TRQTGT, the change in the intake air flow rate delays from the change in the throttle valve opening TH. Accordingly, the torque reduction due to the change in the throttle valve opening TH starts from time t11 after a little delay from time t10.

Figures 12A, 12B, 12C, 12D, 12E:
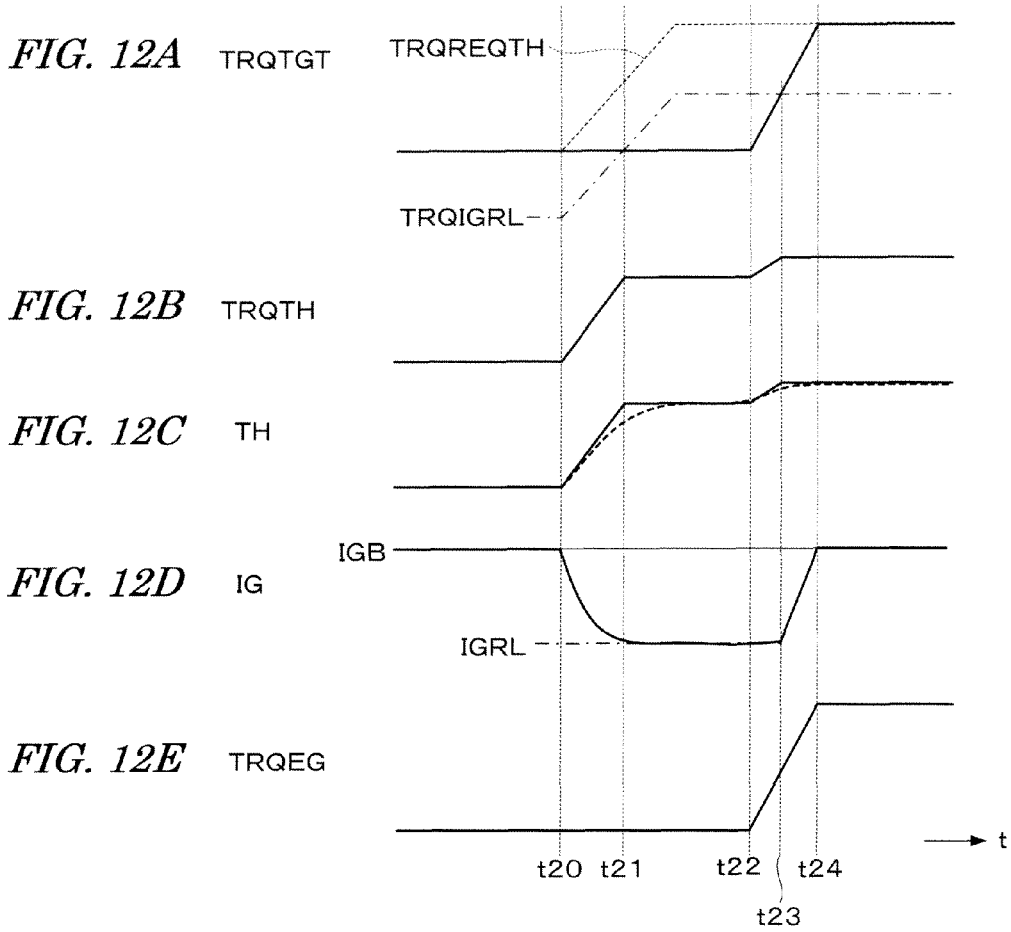
FIGS. 12A-12E show time charts for illustrating the torque maintenance control.

FIGS. 12A-12E are time charts for illustrating the torque maintenance control described above, and respectively show changes in the TM demand torque TRQTGT, the first target torque TRQTH, the throttle valve opening TH, the ignition timing IG, and the engine output torque TRQEG. In FIG. 12A, changes in the increased demand torque TRQREQTH and the retard limit torque TRQIGRL are also shown respectively by the dashed line and the dot-and-dash line. Further, in FIG. 12C, the dashed line shows changes in the intake air flow rate corresponding to changes in the throttle valve opening TH.

As shown in FIG. 12A, the increased demand torque TRQREQTH starts to increase when the torque maintenance request is transmitted at time t20. Since the increased demand torque TRQREQTH is comparatively small during the period from time t20 to time t21, the answer to step S23 of FIG. 8 is negative (NO). Consequently, the first target torque TRQTH is set to the increased demand torque TRQREQTH, and the throttle valve opening TH changes according to the first target torque TRQTH. During the period from time t20 to time t21, the ignition timing IG is gradually retarded so as to make the engine output torque TRQEG unchanged. The ignition timing IG reaches the retard limit IGRL at time t21 (the retard limit torque TRQIGRL becomes equal to the TM demand torque TRQTGT).

After time t21, the answer to step S23 of FIG. 8 is affirmative (YES). Therefore, the first target torque TRQTH is maintained at a value calculated by step S26 of FIG. 8 until time t22. The ignition timing IG is maintained at the retard limit IGRL until time t23.

The TM demand torque TRQTGT starts to increase at time t22, and the first target torque TRQTH increases corresponding to the increase in the TM demand torque TRQTGT, to reach the increased demand torque TRQREQTH at time t23 (the retard limit torque TRQIGRL becomes equal to the TM demand torque TRQTGT). Thereafter, the answer to step S23 of FIG. 8 is negative (NO), and the first target torque TRQTH is maintained at the increased demand torque TRQREQTH. The ignition timing IG is gradually advanced according to the TM demand torque TRQTGT, and reaches the basic ignition timing IGB at time t24.

The engine output torque TRQEG changes so as to follow the TM demand torque TRQTGT and changes.

As described above, in this embodiment, when the torque reduction request is transmitted to the EG-ECU 5, the retard limit IGRL of the ignition timing IG is calculated according to the engine operating condition. Further, the retard limit torque TRQIGRL, which is an engine output torque corresponding to the state where the ignition timing IG is retarded to the retard limit IGRL and the intake air flow rate is equal to a value (GAIRDRV) immediately before starting the torque reduction control, is calculated. When the TM demand torque TRQTGT is less than the retard limit torque TRQIGRL, the engine output torque cannot be reduced to the TM demand torque TRQTGT only by retarding the ignition timing IG. Therefore, the retard limit intake air flow rate GAIRTGT, which is an intake air flow rate at which the engine output torque becomes equal to the TM demand torque TRQTGT in the state where the ignition timing IG is retarded to the retard limit IGRL, is calculated. Further, the ignition timing IG is retarded to the retard limit IGRL and the first target torque TRQTH is set so that the intake air flow rate GAIR coincides with the retard limit intake air flow rate GAIRTGT. Then, the throttle valve opening TH is controlled according to the first target torque TRQTH.

On the other hand, when the TM demand torque TRQTGT is equal to or greater than the retard limit torque TRQIGRL, the engine output torque can be reduced to the TM demand torque TRQTGT only by retarding the ignition timing IG. Therefore, the ignition timing IG is controlled to be retarded so that the engine output torque coincides with the TM demand torque TRQTGT. Consequently, in the transient control for the time when the reduction demand of the engine output torque is transmitted, the reduction in the engine output torque is performed by retarding the ignition timing in consideration of the retard limit IGRL as much as possible, thereby improving response performance of the engine output control.

Further, when the TM demand torque TRQTGT increases after performing the above-described torque reduction control, the output increase control is performed so that the engine output torque coincides with the TM demand torque TRQTGT. In the output increase control, the intake air flow rate is increased by increasing the first target torque TRQTH until the TM demand torque TRQTGT reaches the retard limit torque TRQIGRL if the ignition timing IG is set to the retard limit IGRL. When the TM demand torque TRQTGT exceeds the retard limit torque TRQIGRL, the engine output torque is controlled so as to coincide with the TM demand torque TRQTGT by advancing the ignition timing IG. Therefore, when the TM demand torque TRQTGT further changes immediately after the increase in the TM demand torque TRQTGT, the torque control can be performed by advancing or retarding the ignition timing IG, which improves response performance of the engine output control.

When the torque maintenance request as preparation for the torque increase control for increasing the engine output torque to the increased demand torque TRQREQTH, is transmitted (i.e., when the TM demand torque TRQTGT is equal to the present output torque), the basic increased intake air flow rate GAIRRT, which is an intake air flow rate at which the increased demand torque TRQREQTH is obtained under the condition where the ignition timing IG is set to the basic ignition timing IGB, is calculated.

Further, the retard limit torque TRQIGRL, which is an engine output torque corresponding to the state where the ignition timing IG is retarded to the retard limit IGRL and the intake air flow rate is equal to the basic increased intake air flow rate GAIRRT, is calculated. The retard limit intake air flow rate GAIRTGT, which is an intake air flow rate at which the engine output torque is equal to the present value of the engine output torque (=TRQTGT) under the condition where the ignition timing IG is retarded to the retard limit IGRL, is calculated when the present value of the engine output torque (=TRQTGT) is less than the retard limit torque TRQIGRL. If the present value of the engine output torque (=TRQTGT) is equal to or greater than the retard limit torque TRQIGRL, the first target torque TRQTH is set to the increased demand torque TRQREQTH, and the torque maintenance control for maintaining the present engine output torque is performed as follows: the throttle valve opening TH is controlled so that the intake air flow rate coincides with the basic increased intake air flow rate GAIRRT, and the ignition timing IG is retarded so as to maintain the engine output torque at the present value.

On the other hand, if the present value of the engine output torque is less than the retard limit torque TRQIGRL, the torque maintenance control is performed as follows: the ignition timing IG is retarded to the retard limit IGRL, the first target torque TRQTH is set so that the intake air flow rate coincides with the retard limit intake air flow rate GAIRTGT, and the throttle valve opening TH is controlled according to the first target torque TRQTH. This torque maintenance control makes it possible to maintain the engine output torque at the present value and quickly respond to the subsequent output increase request, thereby improving response performance of the output torque increase control.

In this embodiment, the throttle valve 3 and the actuator 7 constitute the intake air flow rate control means, and the EG-ECU 5 constitutes the retard limit calculating means, the retard limit output calculating means, the retard limit intake air flow rate calculating means, the output reduction control means, the output increase control means, the basic ignition timing calculating means, the normal output control means, the basic increased intake air flow rate calculating means, and the output maintenance control means. Specifically, steps S31 to S33 of FIG. 9 correspond to the retard limit calculating means and step S34 corresponds to the retard limit output calculating means. Further, steps S17 to S19 and S26 to S28 of FIG. 8 correspond to the output reduction control means including the retard limit intake air flow rate calculating means, and steps S23 to S28 correspond to the output maintenance control means including the retard limit intake air flow rate calculating means and the basic increased intake air flow rate calculating means. Further, steps S13 and S14 of FIG. 8 correspond to the normal output control means.

The present invention is not limited to the embodiment described above, and various modifications may be made. For example, the intake air flow rate control means may be configured by a variable lift amount mechanism for continuously changing the lift amount of the intake valve.

Further, in the above-described embodiment, the present invention is applied to the torque reduction control and the torque maintenance control which are required upon the shift-change of the transmission. The present invention is applicable not only to the torque control upon the shift-change but also to the transient torque control when the demand torque (target torque) is changed. For example, the present invention may be applied to the vehicle stabilization control in which the engine demand torque is reduced if the driving wheel slip is detected from the speed difference between the front wheel and the rear wheel, and also to the control in which the intake air flow rate is increased with maintaining the engine output torque as preparation for the load increase of the dynamo driven by the engine due to turn-on of the electric load on the dynamo.

The present invention can also be applied to a control system for a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A control system for an internal combustion engine, which includes intake air flow rate control means for controlling an intake air flow rate of said engine, and performs an engine output control so that an output of said engine coincides with a demand output by changing at least one of the intake air flow rate and an ignition timing of said engine, said control system comprising:

output reduction control means for performing an output reduction control in which the engine output is reduced by changing at least one of the intake air flow rate and the ignition timing, when the demand output decreases;

retard limit calculating means for calculating a retard limit of the ignition timing according to an operating condition of said engine;

retard limit output calculating means for calculating a retard limit output which is an output of said engine corresponding to a state where the ignition timing is retarded to the retard limit and the intake air flow rate is maintained at a value immediately before the demand output decreases; and retard limit intake air flow rate calculating means for calculating a retard limit intake air flow rate when the demand output is less than the retard limit output, the retard limit intake air flow rate being an intake air flow rate at which the engine output is equal to the demand output under the condition where the ignition timing is retarded to the retard limit, wherein said output reduction control means makes the engine output coincide with the demand output by retarding the ignition timing, when the demand output is equal to or greater than the retard limit output, and said output reduction control means retards the ignition timing to the retard limit and controls said intake air flow rate control means so that the intake air flow rate coincides with the retard limit intake air flow rate, when the demand output is less than the retard limit output.

2. A control system according to claim 1, further comprising output increase control means for performing an output increase control so that the engine output coincides with the demand output when the demand output increases after the output reduction control by said output reduction control means, wherein said output increase control means increases the intake air flow rate until the demand output reaches the retard limit output when the ignition timing is set to the retard limit, and advances the ignition timing when the demand output exceeds the retard limit output.

3. A control system according to claim 1, wherein said control system further comprising:

basic ignition timing calculating means for calculating a basic ignition timing according to an operating condition of said engine;

normal output control means for setting the ignition timing to the basic ignition timing and controlling said intake air flow rate control means so that the engine output coincides with the demand output;

output maintenance control means for performing an output maintenance control in which the engine output is maintained at a present value as preparation for increasing the engine output to an increased demand output;

basic increased intake air flow rate calculating means for calculating a basic increased intake air flow rate when the output maintenance control is requested, the basic increased intake air flow rate being an intake air flow rate at which the increased demand output is obtained under the condition where the ignition timing is set to the basic ignition timing;

second retard limit output calculating means for calculating a second retard limit output which is an output of said engine corresponding to a state where the ignition timing is retarded to the retard limit and the intake air flow rate is equal to the basic increased intake air flow rate; and second retard limit intake air flow rate calculating means for calculating a second retard limit intake air flow rate when the present value of the engine output is less than the second retard limit output, the second retard limit intake air flow rate being an intake air flow rate at which the engine output is equal to the present value under the condition where the ignition timing is retarded to the retard limit, wherein said output maintenance control means controls said intake air flow rate control means so that the intake air flow rate coincides with the basic increased intake air flow rate, and retards the ignition timing so that the engine output is maintained at the present value, when the present value of the engine output is equal to or greater than the second retard limit output, and said output maintenance control means retards the ignition timing to the retard limit and controls said intake air flow rate control means so that the intake air flow rate coincides with the second retard limit intake air flow rate, when the present value of the engine output is less than the second retard limit output.

4. A control system for an internal combustion engine, which includes intake air flow rate control means for controlling an intake air flow rate of said engine, and performs an engine output control so that an output of said engine coincides with a demand output by changing at least one of the intake air flow rate and an ignition timing of said engine, said control system comprising:

basic ignition timing calculating means for calculating a basic ignition timing according to an operating condition of said engine;

normal output control means for setting the ignition timing to the basic ignition timing and controlling said intake air flow rate control means so that the engine output coincides with the demand output;

output maintenance control means for performing an output maintenance control in which the engine output is maintained at a present value as preparation for increasing the engine output to an increased demand output;

retard limit calculating means for calculating a retard limit of the ignition timing according to the operating condition of said engine;

basic increased intake air flow rate calculating means for calculating a basic increased intake air flow rate when the output maintenance control is requested, the basic increased intake air flow rate being an intake air flow rate at which the increased demand output is obtained under the condition where the ignition timing is set to the basic ignition timing;

retard limit output calculating means for calculating a retard limit output which is an output of said engine corresponding to a state where the ignition timing is retarded to the retard limit and the intake air flow rate is equal to the basic increased intake air flow rate; and retard limit intake air flow rate calculating means for calculating a retard limit intake air flow rate when the present value of the engine output is less than the retard limit output, the retard limit intake air flow rate being an intake air flow rate at which the engine output is equal to the present value under the condition where the ignition timing is retarded to the retard limit, wherein said output maintenance control means controls said intake air flow rate control means so that the intake air flow rate coincides with the basic increased intake air flow rate, and retards the ignition timing so that the engine output is maintained at the present value, when the present value of the engine output is equal to or greater than the retard limit output, and said output maintenance control means retards the ignition timing to the retard limit and controls said intake air flow rate control means so that the intake air flow rate coincides with the retard limit intake air flow rate, when the present value of the engine output is less than the retard limit output.

5. A control method for an internal combustion engine, which is applied to performing an engine output control so that an output of said engine coincides with a demand output by changing at least one of an intake air flow rate and an ignition timing of said engine, the intake air flow rate of said engine being controlled using an intake air flow rate control device, said control method comprising the steps of:

a) performing an output reduction control in which the engine output is reduced by changing at least one of the intake air flow rate and the ignition timing, when the demand output decreases;

b) calculating a retard limit of the ignition timing according to an operating condition of said engine:

c) calculating a retard limit output which is an output of said engine corresponding to a state where the ignition timing is retarded to the retard limit and the intake air flow rate is maintained at a value immediately before the demand output decreases; and d) calculating a retard limit intake air flow rate when the demand output is less than the retard limit output, the retard limit intake air flow rate being an intake air flow rate at which the engine output is equal to the demand output under the condition where the ignition timing is retarded to the retard limit, wherein the engine output is made to coincide with the demand output by retarding the ignition timing, when the demand output is equal to or greater than the retard limit output, and the ignition timing is retarded to the retard limit and said intake air flow rate control device is controlled so that the intake air flow rate coincides with the retard limit intake air flow rate, when the demand output is less than the retard limit output.

6. A control method according to claim 5, further comprising the step of e) performing an output increase control so that the engine output coincides with the demand output when the demand output increases after performing the output reduction control, wherein the intake air flow rate is increased until the demand output reaches the retard limit output when the ignition timing is set to the retard limit, and the ignition timing is advanced when the demand output exceeds the retard limit output.

7. A control method according to claim 5, wherein said control method further comprising the steps of:

e) calculating a basic ignition timing according to an operating condition of said engine;

f) setting the ignition timing to the basic ignition timing and controlling said intake air flow rate control device so that the engine output coincides with the demand output;

g) performing an output maintenance control in which the engine output is maintained at a present value as preparation for increasing the engine output to an increased demand output:

h) calculating a basic increased intake air flow rate when the output maintenance control is requested, the basic increased intake air flow rate being an intake air flow rate at which the increased demand output is obtained under the condition where the ignition timing is set to the basic ignition timing;

i) calculating a second retard limit output which is an output of said engine corresponding to a state where the ignition timing is retarded to the retard limit and the intake air flow rate is equal to the basic increased intake air flow rate; and j) calculating a second retard limit intake air flow rate when the present value of the engine output is less than the second retard limit output, the second retard limit intake air flow rate being an intake air flow rate at which the engine output is equal to the present value under the condition where the ignition timing is retarded to the retard limit, wherein said intake air flow rate control device is controlled so that the intake air flow rate coincides with the basic increased intake air flow rate, and the ignition timing is retarded so that the engine output is maintained at the present value, when the present value of the engine output is equal to or greater than the second retard limit output, and said the ignition timing is retarded to the retard limit and said intake air flow rate control device is controlled so that the intake air flow rate coincides with the second retard limit intake air flow rate, when the present value of the engine output is less than the second retard limit output.

8. A control method for an internal combustion engine, which is applied to performing an engine output control so that an output of said engine coincides with a demand output by changing at least one of an intake air flow rate and an ignition timing of said engine, the intake air flow rate of said engine being controlled using an intake air flow rate control device, said control method comprising the steps of:

a) calculating a basic ignition timing according to an operating condition of said engine;

b) setting the ignition timing to the basic ignition timing and controlling said intake air flow rate control device so that the engine output coincides with the demand output;

c) performing an output maintenance control in which the engine output is maintained at a present value as preparation for increasing the engine output to an increased demand output:

d) calculating a retard limit of the ignition timing according to the operating condition of said engine:

e) calculating a basic increased intake air flow rate when the output maintenance control is requested, the basic increased intake air flow rate being an intake air flow rate at which the increased demand output is obtained under the condition where the ignition timing is set to the basic ignition timing;

f) calculating a retard limit output which is an output of said engine corresponding to a state where the ignition timing is retarded to the retard limit and the intake air flow rate is equal to the basic increased intake air flow rate; and g) calculating a retard limit intake air flow rate when the present value of the engine output is less than the retard limit output, the retard limit intake air flow rate being an intake air flow rate at which the engine output is equal to the present value under the condition where the ignition timing is retarded to the retard limit, wherein said intake air flow rate control device is controlled so that the intake air flow rate coincides with the basic increased intake air flow rate, and the ignition timing is retarded so that the engine output is maintained at the present value, when the present value of the engine output is equal to or greater than the retard limit output, and said the ignition timing is retarded to the retard limit and said intake air flow rate control device is controlled so that the intake air flow rate coincides with the retard limit intake air flow rate, when the present value of the engine output is less than the retard limit output.

* * * * *